United States Patent [19]

Hunter

[11] 4,415,110

[45] Nov. 15, 1983

[54] LP GAS-OPERATED IMPACT TOOL

[76] Inventor: C. LaMont Hunter, 715 N. University, Blackfoot, Id. 83221

[21] Appl. No.: 293,659

[22] Filed: Aug. 17, 1981

[51] Int. Cl.[3] ..... B25C 1/08

[52] U.S. Cl. ..... 227/10

[58] Field of Search ..... 227/9, 10; 173/134; 123/74, 59 B, 46 B, 46 A, 616, 642

[56] References Cited

U.S. PATENT DOCUMENTS

| | | | |
|---|---|---|---|
| 2,876,751 | 3/1959 | Kolthoff, Jr. | 123/46 B |
| 3,967,771 | 7/1976 | Smith | 227/10 |
| 4,185,508 | 1/1980 | Hardt | 123/58 R |

FOREIGN PATENT DOCUMENTS

| | | | |
|---|---|---|---|
| 53-47810 | 10/1978 | Japan | 227/9 |

*Primary Examiner*—Mark Rosenbaum
*Assistant Examiner*—Timothy V. Eley
*Attorney, Agent, or Firm*—Linval B. Castle

[57] ABSTRACT

A two-cylinder two-cycle LP gas operated internal combustion engine provides high speed high energy impacting for driving nails or the like. The two cylinders are geared together by rack and pinion gearing so that the expansion stroke of the smaller first piston provides the compression stroke of the larger impact piston. A first piezoelectric igniter in the nailing end of the tool is actuated by pressing the tool against the material to be nailed and fires a spark plug in the first cylinder. A cam connected to the shaft of the pinion gear intercoupling the two pistons, triggers a second piezoelectric igniter that fires a plug in the second cylinder to drive the impact piston and its attached hammer rod to drive one nail in a nail magazine in the end of the tool. The impacting high energy expansion stroke of the second cylinder provides the next compression stroke of the smaller first cylinder which is again fired by the next actuation of the first piezoelectric igniter.

7 Claims, 7 Drawing Figures

LP GAS-OPERATED IMPACT TOOL

BRIEF SUMMARY OF THE INVENTION

This invention relates to hand-held impact tools and particularly to a novel propane gas-operated high-speed hand-held impact tool for driving nails, or the like.

Impact tools of the type to be described are generally pneumatically powered and are extensively used in the building trades by roofers, framers, sheathers, pallet builders, etc., for rapidly driving fasteners, such as nails ranging in size from about 6 to 16 penny. The pneumatic power drivers operate quite satisfactorily and are capable of driving four or five nails per second, but the requirement for relatively large air compressors that are costly to operate and for long heavy air hoses often present problems to the operators. Pneumatic nailers present extra problems to roofers who must haul long, heavy, high-pressure hoses to roof locations and are often required to climb down to adjust or restart the air compressors.

The nailing machine or impact tool to be described eliminates the problems with air compressors and heavy hoses in that it includes a small internal combustion engine powered by low pressure (LP) propane gas preferably supplied from a small 11-ounce gas bottle normally hung from the operator's belt and which provides sufficient fuel for over 30,000 nailings. The combustion of LP gas in the novel engine results in a very high speed operation of over six nailings per second and with an energy that is over three and one-half times that available from pneumatic tools operating at a pressure of 100 psi, thereby permitting nailing into concrete as presently done with hardened nails driven by 22 caliber charges. The impact tool is relatively light weight, weighing less than nine pounds, and its high output energy very readily drives nails of from 6 to 16 penny.

Briefly described, the high-speed, hand-held impact tool includes a 2-cylinder 2-cycle LP gas engine, the two pistons of which are coupled together by a pinion that engages rack gears in the side surface of each piston. A conventional prepackaged nail magazine is loaded at the tool's impactor end to which is also attached a piezoelectric igniter. When the movable arm of the igniter is pressed against an object to be nailed, the igniter generates a high voltage which is applied to a spark plug that fires the compressed gas/air mixture in a first cylinder. The resulting expansion stroke of the first piston is transmitted by the rack and pinion gears to provide the compression stroke of a second piston which carries the nail driving rod or hammer. A cam connected to the pinion gear shaft then drives the arm of a second piezoelectric igniter which fires a spark plug in the second cylinder to linearly drive its piston and hammer to the next prepackaged nail while simultaneously applying the compression stroke to the first piston where it remains until the first igniter is again pressed against an object to be nailed.

BRIEF DESCRIPTION OF THE DRAWINGS

In the drawings which illustrate the preferred embodiment of the invention.

DETAILED DESCRIPTION OF A PREFERRED EMBODIMENT

Figure 1:
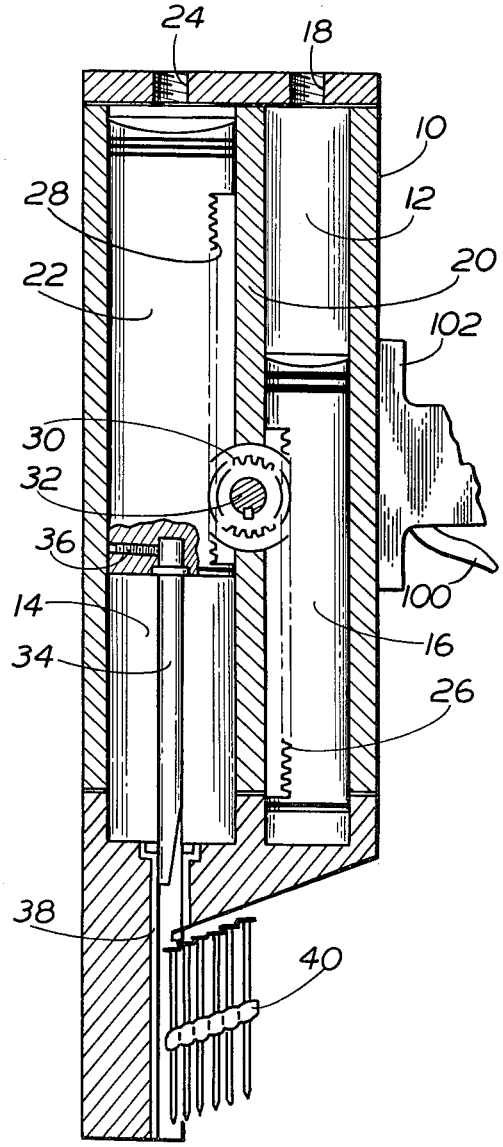
FIG. 1 is a sectional side view of the impact tool.

FIG. 1 is a sectional side view of the impact tool and illustrates a substantially rectangular housing 10 having a pair of spaced parallel longitudinal cylinders 12 and 14. The bore of cylinder 12 is preferably 1-$\frac{1}{4}$ inches in diameter and contains a piston 16 having at least one compression ring and an oil ring at the end proximate the threaded spark plug hole 18 in the end of the housing 10 and substantially coaxial with the cylinder 12. Cylinder 14, which is spaced from cylinder 12 by a partition 20 of approximately $\frac{3}{4}$ inch in width contains a piston 22 with a preferred diameter of 2-$\frac{1}{4}$ inches and with suitable oil and compression rings at the end adjacent the threaded spark plug hole 24 in the end of the housing 10. Rack gears 26 and 28 are cut in the side surfaces of pistons 16 and 22, respectively, and along a longitudinal line parallel with the axis of each piston. A pinion gear 30 keyed to a rotatable shaft 32 that is normal to the axes of the cylinders and extends through the partition 20 and through the sides of the housing 10, engages both rack gears at a point where the piston 16 is at the bottom of its stroke and the piston 22 is at the top. The rack gears 26 and 28 should be sufficiently long so that each piston may go through a longitudinal stroke of 3-$\frac{1}{2}$ inches and the rack gears must be sufficiently deep in the sides of their respective piston so that the pinion 30 will have a diameter that will permit a rotation of only about 300° throughout each piston stroke, as will be subsequently explained.

The piston 22, hereinafter referred to as the impact piston 22, carries an impact tool or hammer 34 of conventional design, coaxial with the piston 22 and attached within an axial collet in the piston by a suitable set screw 36 in a tapered hole through the piston side wall. Hammer 34 preferably has a total length of approximately 5 inches and the end of the hammer opposite the piston 22 is fitted into and slides within a tubular receiver 38 which preferably includes an O-ring seal that restricts the rapid escape of air from the bottom of the cylinder 14. A conventional pre-loaded nail magazine 40 is filled to the end of the housing and aligned so that the end of the hammer 34 will drive the first nail in the magazine.

Figure 2:
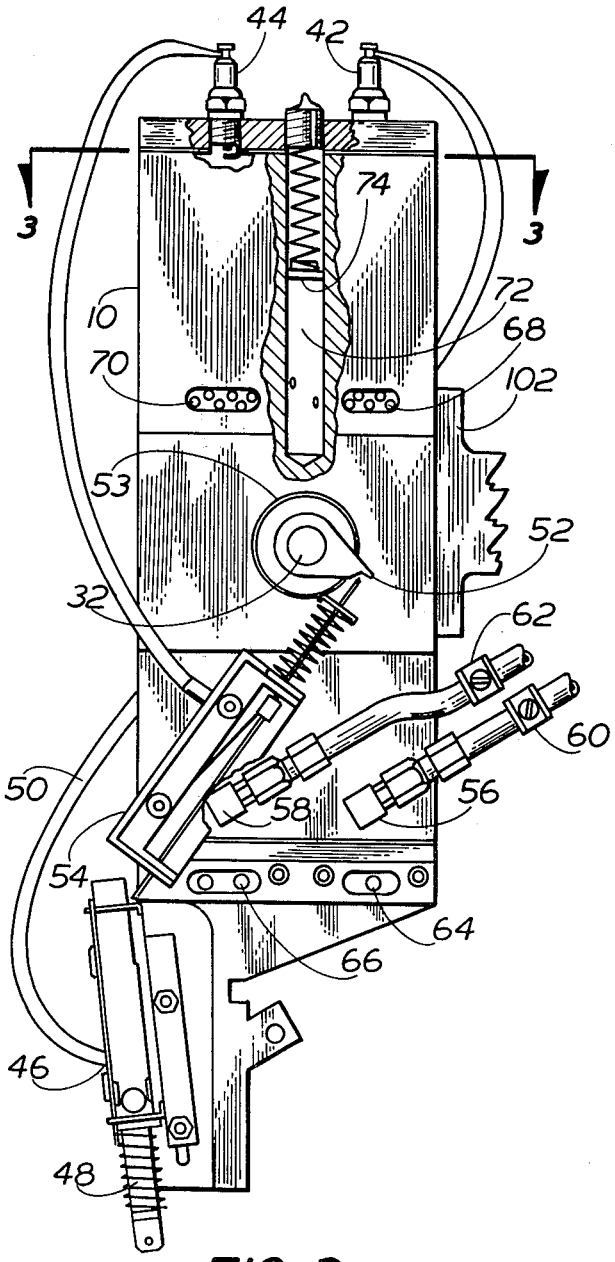
FIG. 2 is an exterior side view of the tool with a sectional portion illustrating a piston oiler.

FIG. 2 is an exterior side view of the impact tool and illustrates spark plugs 42 and 44, respectively positioned in the spark plug holes 18 and 24 of FIG. 1. Spark plug 42 is associated with the smaller diameter cylinder 12 and derives its spark from a piezoelectric igniter 46 which develops several thousand volts upon the linear depressing of its spring-loaded actuator arm 48.

The piezoelectric igniter 46 is commercially available and may be a type 1M21S manufactured by NKG Corporation of Glenview, Ill. The high voltage thus generated is transmitted from the igniter 46 through a suitable spark plug cable 50 to the spark plug 42, as illustrated. During operation of the impact tool, the spark plug 42 will ignite the LP gas mixture within the cylinder 12 to force the piston 16 downward in an expansion stroke.

This expansion stroke of the small piston 16 is transmitted through the rack and pinion gearing into a compression stroke of the impact piston 22. The rotation of the spur gear shaft 32 simultaneously rotates a cam 52 attached to the shaft 32 as shown in FIG. 2. This rotation of cam 52 will actuate a second type 1M21S piezoelectric igniter 54 which provides a high voltage to the spark plug 44 at the time that the impact piston 22 reaches the top of its compression stroke. This ignites the compressed gas mixture within the cylinder 14 to drive the impact cylinder 22 and its associated hammer 34. The cam 52 that rotates with the pinion shaft 32 is preferably separated from the side of the housing by a friction clutch 53 that applies an adjustable amount of drag to the rotation of the cam. The clutch 53 should be adjusted so that the small piston 16, when at the top of its compression stroke, will not be forced downward by the compressed fuel mixture to a point where the fuel mixture cannot be ignited by the next actuation of the igniter 46. It should be noted that the cam 52 should be rotatable through only about a 300° arc, as previously mentioned, so that it may depress the actuator arm of the igniter 54 at one end of its stroke and yet will not come in contact with the arm or its spring at the opposite end of its rotation.

Illustrated in FIG. 2 are gas inlet valves 56 and 58 which meter low pressure propane gas into the cylinders 12 and 14, respectively, as will be subsequently explained. Each of the gas inlet valves 56 and 58 are at the ends of tubing that lead from an LP gas source and which contain adjustable needle valves 60 and 62, respectively. Inlet air that is mixed with the metered LP gas to an air/fuel ratio of 15.6 to 1 is entered through ports 64 and 66. Exhaust ports for the cylinders 12 and 14 are indicated at 68 and 70, respectively.

Figure 3:
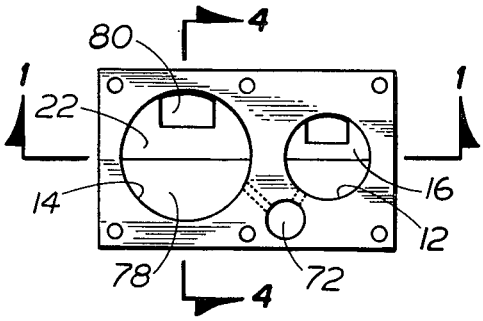
FIG. 3 is a top end view taken along the lines 3–3 of FIG. 2.

Also illustrated in FIG. 2 is a piston oiler cylinder 72 having a pair of very small ports entering each of the cylinders 12 and 14 as illustrated in FIG. 3. As illustrated in FIG. 2, a spring-loaded piston 74 urges the oil from the oil cylinder 72 through the small ports into the respective cylinders 12 and 14.

Figure 4:
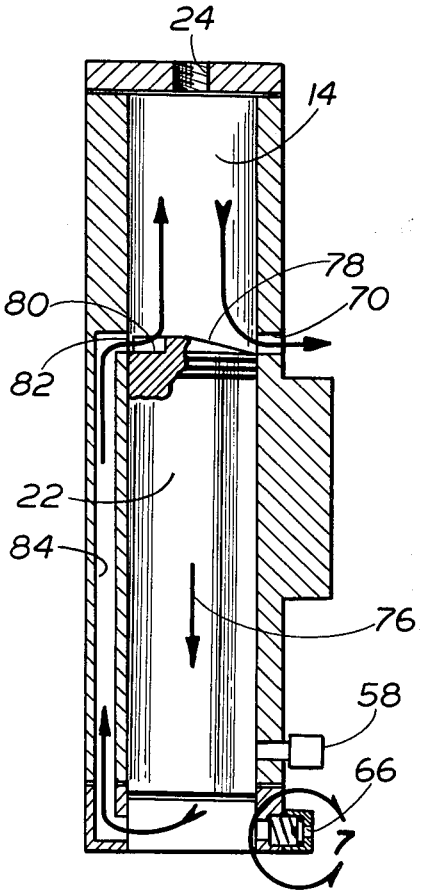
FIG. 4 is a sectional edge view of the tool taken along the lines 4–4 of FIG. 3.

FIG. 4 is a sectional view of the edge of the impact tool taken along the lines 4—4 of FIG. 3 and illustrates the details of the impact piston 22 and the fuel intake and exhaust system. When the impact piston 22 is forced into its compression stroke by the firing and the resulting expansion stroke of the smaller cylinder 12, low pressure gas and air is drawn into the lower section of the cylinder 14 through one-way gas inlet valve 58 and air inlet check valve 66 which is illustrated in detail in FIG. 7. When the spark plug in the cylinder 14 is fired and the impact piston 22 starts its expansion stroke, as illustrated by the arrow 76 in FIG. 4, the fuel mixture becomes slightly compressed in the relatively large volume below the piston 22 and in the conduit 84. When piston 22 has completed its expansion stroke, the edge of a slanted roof section 78 on the cylinder head passes over the inner surface of the exhaust port 70 thereby permitting the escape of burnt exhaust gases. Diametrically opposite the slanted section 78 is a rectangular step section 80 in the cylinder head. The floor of this step is thus an intake valve which is opened when it passes over the inner surface of an intake port 82 which is connected by the longitudinal conduit 84 in the wall of the housing 10 between the port 82 and the lower section of the cylinder 14 into which low pressure fuel and air have entered and have become intermixed. As shown by the arrows in FIG. 4, the fuel mixture enters the combustion chamber through the port 82 where the riser portion of the step section 80 directs the mixture toward the spark plug and away from the open exhaust port 70. The fuel mixture thus helps purge the exhaust gases while simultaneously filling the combustion chamber with fuel to be compressed during the next compression stroke which is initiated by the next firing of the smaller cylinder 12. An identical intake and exhaust configuration is employed for the smaller cylinder 12.

If there is an appreciable break in time during the operation of the impact tool, the compressed fuel mixture in the smaller cylinder 12 may escape and the cylinder will not fire until it is recharged. This is very easily and quickly accomplished by cranking the two-cylinder engine through one complete cycle.

Figure 5:
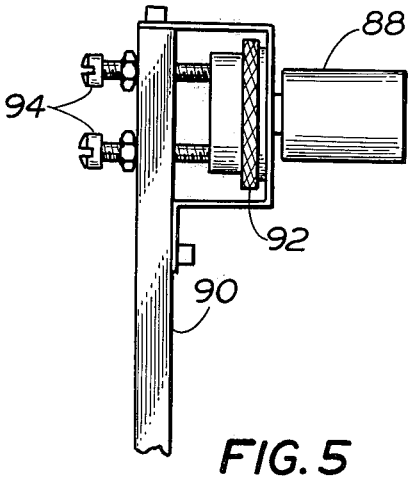
FIG. 5 is a side view of a crank employed for the initial starting of the impact tool.

FIG. 5 illustrates the preferred embodiment of the hand-operated crank having a female socket 88 adapted to fit a corresponding stud (not shown) on either or both ends of the rotatable pinion shaft 32. The crank socket 88 is coupled to a handle section 90 of suitable length through a friction clutch 92 which is adjustable by two or more adjustment screws 94. Thus, when the impact tool is first used or used after a prolonged interval, the crank of FIG. 5 is connected to the pinion shaft 32 and rotated in a first direction until the impact tool pistons are aligned as illustrated in FIG. 1 and then reversed and rotated in a second direction so that the smaller cylinder 16 has compressed the gases admitted through its intake system and is ready to be fired by depressing the igniter arm 48 against the material to be nailed.

Figure 6:
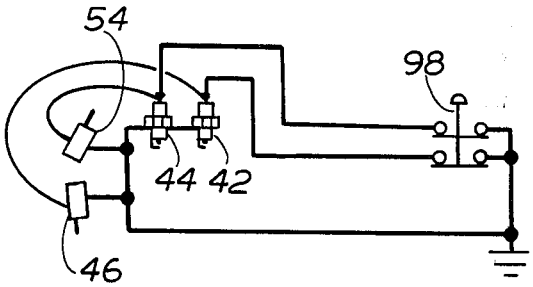
FIG. 6 is a schematic diagram of the electrical system of the impact tool.

FIG. 6 is an electrical schematic diagram illustrating the electrical circuitry of the impact tool. The body portions of spark plugs 42 and 44 and of the piezoelectric igniters 46 and 54 are at the ground potential of the impact tool housing 10. When the actuating arm of the igniters 46 and 54 is depressed, a high voltage surge is applied to the electrode of the respective spark plug. A safety circuit is provided by a normally closed two-pole single-throw switch 98 which is operated by depressing a trigger 100 in the impact tool handle 102 as shown in FIG. 1. The terminals on one side of the switch 98 are coupled to the housing and are at ground potential; the two terminals on the opposite side of the switch are respectively coupled to the spark plugs 42 and 44. The switch 98, normally closed, connects the spark electrodes of the spark plugs 42 and 44 to ground so that if the igniters 46 and 54 are accidentally actuated, their high voltage output will be grounded and the spark plugs will not fire. When it is desired to operate the impact tool, it is only necessary to depress the trigger 100 to thereby open the switch 98 and to remove the spark plug electrodes from ground and thereby permit the high voltage from the igniters 46 and 54 to fire the plug upon depression of their actuator arms. If desired, switch 98 may be a single pole switch for selectively ungrounding only the igniter 46 so that igniter 54 is always operable by the cam 52.

Figure 7:
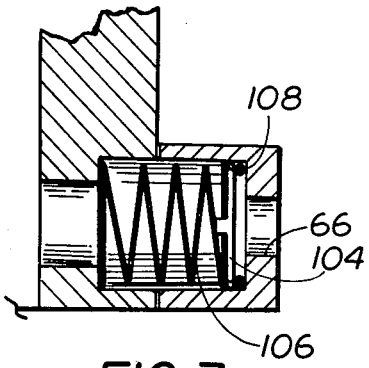
FIG. 7 is a sectional view illustrating in detail the air inlet valve depicted in FIG. 4.

FIG. 7 is a sectional view illustrating in detail the intake port 66 illustrated in FIG. 4. As shown, the air intake includes a check valve comprising a cylindrical chamber contacting a disc 104 of a slightly smaller diameter than the cylindrical chamber. The disc is spring-loaded by the spring 106 against the intake port 66 and is separated therefrom by an O-ring 108 which seals the lower portion of the cylinder 14 during the expansion stroke of the piston 22 but which admits air into the lower portion of the cylinder 14 during the compression stroke of the piston 22.

I claim:

1. A high speed impact tool comprising:

a housing, a gas fueled internal combustion engine within said housing, said engine having first and second parallel cylinders each having first and second ends and each containing a piston longitudinally moveable within its respective cylinder;

a pinion gear interconnecting opposite ends of parallel facing ranks on the exterior walls of the pistons in said first and second cylinders;

fuel supply means for admitting a fuel air mixture into said first and second cylinders;

means for urging the piston in said first cylinder toward the first end of said first cylinder for compressing the fuel air mixture in said first cylinder end;

first electrical spark-generating means in the first end of said first cylinder; and voltage generating means coupled to said spark-generating means and responsive to actuation by an external force for generating a high electrical voltage output for firing said spark-generating means and said fuel air mixture to drive the piston in said first cylinder through said first cylinder toward the second end of said cylinder and the piston in said second first cylinder toward the first end of said second cylinder to thereby compress the fuel air mixture in said second cylinder.

2. The impact tool claimed in claim 1 wherein said voltage generating means is a piezoelectric igniter mounted at the end of said housing adjacent said second cylinder end, said igniter having an actuator arm extending outward from said housing, said igniter developing a high voltage upon depression of said arm.

3. The impact tool claimed in claim 2 including second spark-generating means in the first end of said second cylinder, said second spark-generating means coupled to the output of a second piezoelectric igniter that generates a high-voltage output when the piston in said second cylinder substantially completes its compression stroke for igniting said compressed fuel, for driving the second piston in an expansion impact stroke toward the second end of said second cylinder, and for providing a next compression stroke to the piston in said first cylinder.

4. The impact tool claimed in claim 3 wherein the piston in said second cylinder includes means for mounting a first end of an impact driving rod to the second end of said second piston and coaxial therewith, the opposite end of said driving rod being slidable through an aperture coaxial with said second piston and in an end of said housing for providing impact energy to receiving means exterior of said housing.

5. The impact tool claimed in claim 4 wherein said receiving means is adapted to receive a magazine of prepackaged nails.

6. The impact tool claimed in claim 4 wherein said pinion gear is mounted to a rotatable shaft extending through said housing in the space between said first and second spaced parallel cylinders and normal to the axis of said parallel cylinders, and wherein said second piezoelectric igniter is actuated by a cam rotated by said rotatable pinion gear shaft.

7. The impact tool claimed in claim 4 or 6 further including a manually operable, normally closed switch coupled between at least said first spark generating means and said housing for grounding the output of said first igniter until said switch is opened.

* * * * *